US010570683B2

(12) United States Patent
Boone

(10) Patent No.: US 10,570,683 B2
(45) Date of Patent: Feb. 25, 2020

(54) RIG CONTROL APPARATUS, SYSTEM, AND METHOD FOR IMPROVED MUD-PULSE TELEMETRY

(71) Applicant: Nabors Drilling Technologies USA, Inc., Houston, TX (US)

(72) Inventor: Scott Gilbert Boone, Houston, TX (US)

(73) Assignee: Nabors Drilling Technologies USA, Houston, TX (US)

( * ) Notice: Subject to any disclaimer, the term of this patent is extended or adjusted under 35 U.S.C. 154(b) by 3 days.

(21) Appl. No.: 15/834,798

(22) Filed: Dec. 7, 2017

(65) Prior Publication Data

US 2019/0178043 A1 Jun. 13, 2019

(51) Int. Cl.

| | |
|---|---|
| ***E21B 21/08*** | (2006.01) |
| ***E21B 47/16*** | (2006.01) |
| ***E21B 4/02*** | (2006.01) |
| *E21B 7/00* | (2006.01) |
| *E21B 47/12* | (2012.01) |

(52) U.S. Cl.

CPC ..... *E21B 21/08* (2013.01); *E21B 4/02* (2013.01); *E21B 47/16* (2013.01); *E21B 7/002* (2013.01); *E21B 47/122* (2013.01)

(58) Field of Classification Search

CPC . E21B 21/08; E21B 4/02; E21B 47/16; E21B 7/002; E21B 47/122

See application file for complete search history.

(56) References Cited

U.S. PATENT DOCUMENTS

| | | | | |
|---|---|---|---|---|
| 4,188,624 | A * | 2/1980 | Hochsprung | E21B 21/08 340/606 |
| 2016/0090800 | A1* | 3/2016 | Jeffryes | E21B 47/18 175/25 |
| 2017/0122047 | A1* | 5/2017 | Turner | E21B 21/08 |

* cited by examiner

*Primary Examiner* — Amine Benlagsir

(74) *Attorney, Agent, or Firm* — Haynes and Boone, LLP

(57) ABSTRACT

A rig control apparatus, system, and method according to which a mud pump is ramped up toward a full-operational pumping pressure to circulate drilling mud via a drill string between a surface location and a downhole tool, the downhole tool being connected to the drill string and positioned within a wellbore, the flow of the drilling mud between the surface location and the downhole tool is stabilized prior to the mud pump reaching the full-operational pumping pressure, data is transmitted via mud-pulse telemetry from the downhole tool to the surface location when the flow of the drilling mud between the surface location and the downhole tool is stabilized, and the mud pumps are ramped up further to the full-operational pumping pressure.

12 Claims, 5 Drawing Sheets

RIG CONTROL APPARATUS, SYSTEM, AND METHOD FOR IMPROVED MUD-PULSE TELEMETRY

TECHNICAL FIELD

The present disclosure relates generally to oil and gas drilling and production operations, and, more particularly, to a rig control apparatus, system, and method for improved mud-pulse telemetry.

BACKGROUND

At the outset of a drilling operation, drillers typically establish a drill plan that includes a steering objective location (or target location) and a drilling path to the steering objective location. Once drilling commences, the bottom-hole assembly (BHA) may be directed or "steered" from a vertical drilling path (in any number of directions) to follow the proposed drill plan. For example, to recover an underground hydrocarbon deposit, a drill plan might include a vertical bore to the side of a reservoir containing a deposit, then a directional or horizontal bore that penetrates the deposit. The operator may then follow the plan by steering the BHA through the vertical and horizontal aspects in accordance with the plan.

Measurement while drilling (MWD) tools take periodic surveys allowing operators to assess whether the BHA (and therefore the drill-bore itself) is substantially following the drill plan. Each survey may yield a measurement of the inclination and azimuth (or compass heading) of the BHA at a particular location in the well. In addition to inclination and azimuth, the data obtained during each survey may also include hole depth data, drill string rotational data, delta pressure data (across the downhole drilling motor), and modeled dogleg data, among other data. These measurements may be made at discrete points in the well, and the approximate path of the wellbore may be computed from these discrete points. Conventionally, a survey is conducted at each drill pipe or stand connection. Data from the surveys can be communicated to the surface using mud-pulse telemetry.

In order for effective mud-pulse telemetry to occur, such surveys must be communicated during periods of "stable" fluid flow, as unstable or poor fluid flow may result in the surface being unable to decode the pulsing signal from the downhole tool. Moreover, to ensure the correct wellbore path is being maintained, surveys are often received before the drilling of the next stand or wellbore segment is initiated (e.g., via rotary drilling or slide drilling). Conventional MWD systems are programmed to transmit survey data only after a designated time delay period intended to allow the associated mud pumps to reach full drilling operational pressures and provide a stable fluid flow. However, waiting for the mud pump(s) to be fully ramped up and to establish "stable" fluid flow before transmitting survey data can cause significant delays. As an example, the designated time delay period may be significantly longer than the actual time required for the pump to reach its full drilling operational pressure. The difference between the actual time required for the pump to reach its full drilling operational pressure and the time that the MWD system begins transmitting survey data is dead time or unproductive time. As a result, the time required to drill each stand may be greater than it could otherwise be. Over time, such a delay on each individual stand adds up to a large amount of wasted rig time. Therefore, what is needed is an apparatus, system, and/or method that addresses one or more of the foregoing issues, and/or one or more other issues.

BRIEF DESCRIPTION OF THE DRAWINGS

FIG. 3(*b*) is a flow diagram of a portion of the method of FIG. 3(*a*), according to one or more embodiments of the present disclosure.

FIG. 3(*c*) is a flow diagram of another portion of the method of FIG. 3(*a*), according to one or more embodiments of the present disclosure.

FIG. 3(*d*) is a flow diagram of yet another portion of the method of FIG. 3(*a*), according to one or more embodiments of the present disclosure.

DETAILED DESCRIPTION

Figure 1:
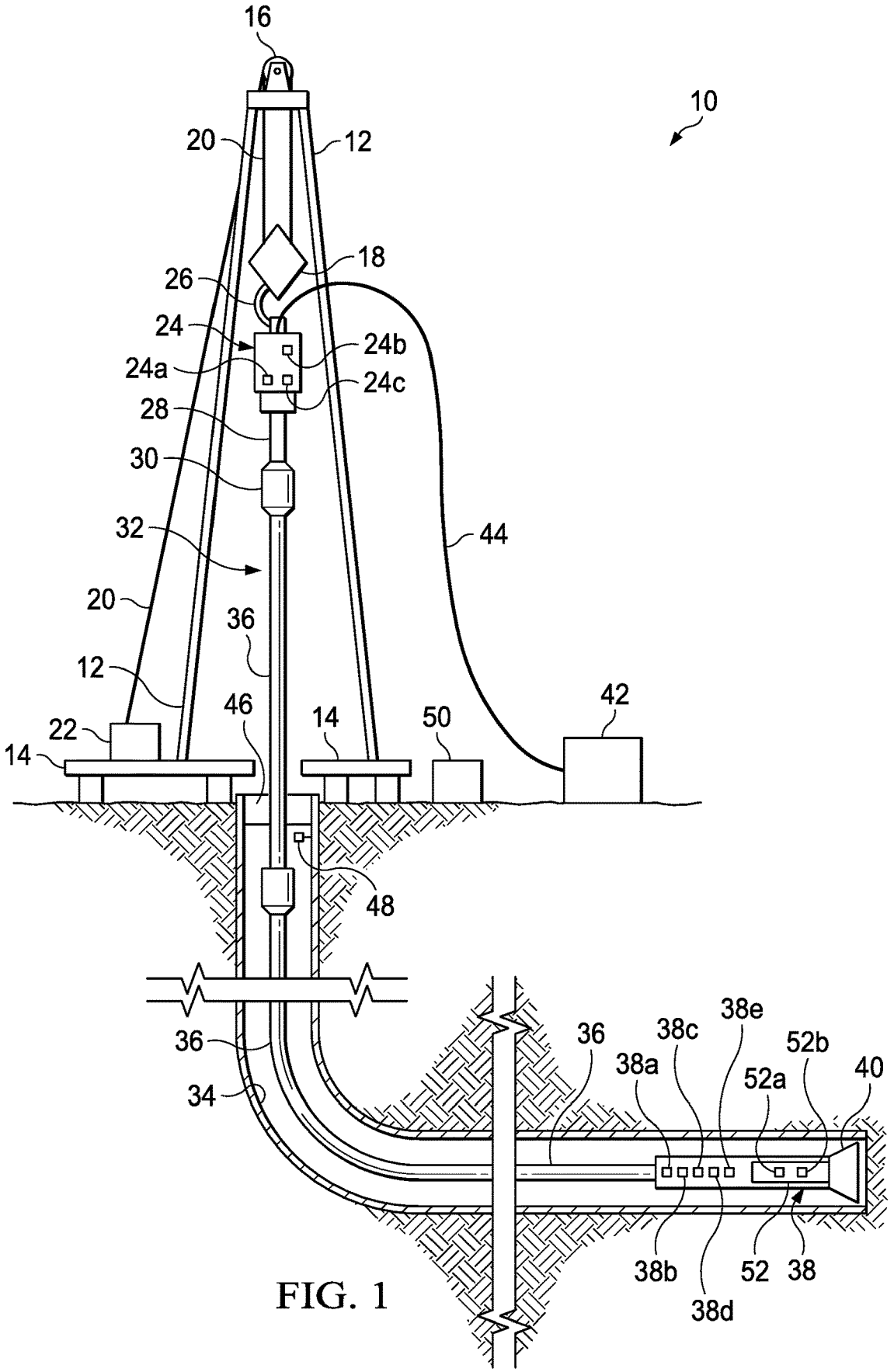
FIG. 1 is an elevational/schematic view of a drilling rig, according to one or more embodiments of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Generally, the process of "drilling a stand down" begins when the stand connection is made up and ends when the stand has been drilled and set back in slips at connection height. More particularly, the process of "drilling a stand down" may be divided into a series of tasks, which may include one or more of the following, among others: making up the stand connection, transitioning from slips-to-weight, initiating rotary drilling, transitioning from rotary drilling to slide drilling (i.e., when directional drilling is required), transitioning from slide drilling to rotary drilling (i.e., when directional drilling is no longer required), drilling the stand to completion, reaming the drilled hole section, and setting the stand in slips at connection height. To enable drilling in accordance with the well plan, these tasks may be carried out in different orders and/or combinations for each stand (or portion thereof) in the drill string.

The present disclosure aims to decrease delays caused by waiting for overly long periods of time for the mud pump(s) to be fully ramped up to a stable operational drilling pressure before transmitting a survey from the downhole tool. While conventional systems are programmed to include a long delay time as mud pumps reach full and stable operational drilling pressures prior to transmitting survey data, the apparatus, systems, and methods herein control a drilling rig to create stable fluid flow for transmission of survey data irrespective of the full operation drilling pressure of the mud pump. In some embodiments, the transmission of survey data occurs during the process of ramping to full-operational pumping pressure. To this end, a systematic approach is disclosed for optimizing the manner in which a drilling rig's control system controls the drawworks, the drive system, and/or the mud pump(s) during the transmission of survey data from the downhole tool. The downhole tool is configured to detect when the mud pump(s) have been turned on and configured to wait a predetermined "survey delay time" thereafter before transmitting the survey to the surface (e.g., via mud-pulse telemetry). The survey delay time may be pre-programmed and determined based on one or more characteristics of the mud pump(s), the drive system, the drawworks, the downhole tool technology, one or more other characteristics of the drilling rig, and/or other factor(s). The drilling rig's control system is configured to create a time window encompassing the end of this survey delay time in which the drawworks, the drive system, and the mud pump(s) are controlled in a manner that stabilizes fluid flow to prevent, or at least reduce, poor decoding of the survey data (i.e., the mud-pulse telemetry data) from the downhole tool. This effectively synchronizes the expiration of the predetermined survey delay time on the MWD tool with the time window in the drilling rig's control system so that transmission occurs during stabilized fluid flow in the time window.

Referring to FIG. 1, an embodiment of a drilling rig for implementing the aims of the present disclosure is schematically illustrated and generally referred to by the reference numeral 10. The drilling rig 10 is or includes a land-based drilling rig—however, one or more aspects of the present disclosure are applicable or readily adaptable to any type of drilling rig (e.g., a jack-up rig, a semisubmersible, a drill ship, a coiled tubing rig, a well service rig adapted for drilling and/or re-entry operations, and a casing drilling rig, among others). The drilling rig 10 includes a mast 12 that supports lifting gear above a rig floor 14, which lifting gear includes a crown block 16 and a traveling block 18. The crown block 16 is coupled to the mast 12 at or near the top of the mast 12. The traveling block 18 hangs from the crown block 16 by a drilling line 20. The drilling line 20 extends at one end from the lifting gear to drawworks 22, which drawworks 22 are configured to reel out and reel in the drilling line 20 to cause the traveling block 18 to be lowered and raised relative to the rig floor 14. The other end of the drilling line 20 (known as a dead line anchor) is anchored to a fixed position, possibly near the drawworks 22 (or elsewhere on the rig).

The drilling rig 10 further includes a top drive 24, a hook 26, a quill 28, a saver sub 30, and a drill string 32. The top drive 24 is suspended from the hook 26, which hook is attached to the bottom of the traveling block 18. The quill 28 extends from the top drive 24 and is attached to a saver sub 30, which saver sub is attached to the drill string 32. The drill string 32 is thus suspended within a wellbore 34. The quill 28 may instead be attached directly to the drill string 32. The term "quill" as used herein is not limited to a component which directly extends from the top drive 24, or which is otherwise conventionally referred to as a quill 28. For example, within the scope of the present disclosure, the "quill" may additionally (or alternatively) include a main shaft, a drive shaft, an output shaft, and/or another component which transfers torque, position, and/or rotation from the top drive 24 or other rotary driving element to the drill string 32, at least indirectly. Nonetheless, albeit merely for the sake of clarity and conciseness, these components may be collectively referred to herein as the "quill."

The drill string 32 includes interconnected sections of drill pipe 36, a bottom-hole assembly ("BHA") 38, and a drill bit 40. The BHA 38 may include stabilizers, drill collars, and/or measurement-while-drilling ("MWD") or wireline conveyed instruments, among other components. The drill bit 40 is connected to the bottom of the BHA 38 or is otherwise attached to the drill string 32. One or more mud pumps 42 deliver drilling fluid to the drill string 32 through a hose or other conduit 44, which conduit may be connected to the top drive 24. The downhole MWD or wireline conveyed instruments may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, and downloaded from the instrument(s) at the surface and/or transmitted real-time to the surface. Data transmission methods may include, for example, digitally encoding data and transmitting the encoded data to the surface as pressure pulses in the drilling fluid or mud system. The MWD tools and/or other portions of the BHA 38 may have the ability to store measurements for later retrieval via wireline and/or when the BHA 38 is tripped out of the wellbore 34.

The drilling rig 10 may also include a rotating blow-out preventer ("BOP") 46, such as if the wellbore 34 is being drilled utilizing under-balanced or managed-pressure drilling methods. In such an embodiment, the annulus mud and cuttings may be pressurized at the surface, with the actual desired flow and pressure possibly being controlled by a choke system, and the fluid and pressure being retained at the well head and directed down the flow line to the choke system by the rotating BOP 46. The drilling rig 10 may also include a surface casing annular pressure sensor 48 configured to detect the pressure in the annulus defined between, for example, the wellbore 34 (or casing therein) and the drill string 32. In the embodiment of FIG. 1, the top drive 24 is utilized to impart rotary motion to the drill string 32. However, aspects of the present disclosure are also applicable or readily adaptable to embodiments utilizing other drive systems, such as a power swivel, a rotary table, a coiled tubing unit, a downhole motor, and/or a conventional rotary rig, among others.

The drilling rig 10 also includes a control system 50 configured to control or assist in the control of one or more components of the drilling rig 10—for example, the control system 50 may be configured to transmit operational control signals to the drawworks 22, the top drive 24, the BHA 38 and/or the mud pump(s) 42. The control system 50 may be a stand-alone component installed near the mast 12 and/or other components of the drilling rig 10. In some embodiments, the control system 50 includes one or more systems located in a control room proximate the drilling rig 10, such as the general purpose shelter often referred to as the "doghouse" serving as a combination tool shed, office, communications center, and general meeting place. The control system 50 may be configured to transmit the operational control signals to the drawworks 22, the top drive 24, the BHA 38, and/or the mud pump(s) 42 via wired or wireless transmission (not shown). The control system 50 may also be configured to receive electronic signals via wired or wireless transmission (also not shown) from a variety of sensors included in the drilling rig 10, where each sensor is configured to detect an operational characteristic or parameter. The sensors from which the control system 50 is configured to receive electronic signals via wired or wireless transmission (not shown) may include one or more of the following: a torque sensor 24*a*, a speed sensor 24*b*, a WOB sensor 24*c*, a downhole annular pressure sensor 38*a*, a shock/vibration sensor 38*b*, a toolface sensor 38*c*, a WOB sensor 38*d*, the surface casing annular pressure sensor 48, a mud motor delta pressure ("ΔP") sensor 52*a*, and one or more torque sensors 52*b*.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data. The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the drilling rig 10.

The drilling rig 10 may include any combination of the following: the torque sensor 24*a*, the speed sensor 24*b*, and the WOB sensor 24*c*. The torque sensor 24*a* is coupled to or otherwise associated with the top drive 24—however, the torque sensor 24*a* may alternatively be located in or associated with the BHA 38. The torque sensor 24*a* is configured to detect a value (or range) of the torsion of the quill 28 and/or the drill string 32 in response to, for example, operational forces acting on the drill string 32. The speed sensor 24*b* is configured to detect a value (or range) of the rotational speed of the quill 28. The WOB sensor 24*c* is coupled to or otherwise associated with the top drive 24, the drawworks 22, the crown block 16, the traveling block 18, the drilling line 20 (which includes the dead line anchor), or another component in the load path mechanisms of the drilling rig 10. More particularly, the WOB sensor 24*c* includes one or more sensors different from the WOB sensor 38*d* that detect and calculate weight-on-bit, which can vary from rig to rig (e.g., calculated from a hook load sensor based on active and static hook load).

Further, the drilling rig 10 may additionally (or alternatively) include any combination of the following: the downhole annular pressure sensor 38*a*, the shock/vibration sensor 38*b*, the toolface sensor 38*c*, and the WOB sensor 38*d*. The downhole annular pressure sensor 38*a* is coupled to or otherwise associated with the BHA 38, and may be configured to detect a pressure value or range in the annulus-shaped region defined between the external surface of the BHA 38 and the internal diameter of the wellbore 34 (also referred to as the casing pressure, downhole casing pressure, MWD casing pressure, or downhole annular pressure). Such measurements may include both static annular pressure (i.e., when the mud pump(s) 42 are off) and active annular pressure (i.e., when the mud pump(s) 42 are on). The shock/vibration sensor 38*b* is configured for detecting shock and/or vibration in the BHA 38. The toolface sensor 38*c* is configured to detect the current toolface orientation of the drill bit 40, and may be or include a magnetic toolface sensor which detects toolface orientation relative to magnetic north or true north. In addition, or instead, the toolface sensor 38*c* may be or include a gravity toolface sensor which detects toolface orientation relative to the Earth's gravitational field. In addition, or instead, the toolface sensor 38*c* may be or include a gyro sensor. The WOB sensor 38*d* may be integral to the BHA 38 and is configured to detect WOB at or near the BHA 38.

Further still, the drilling rig 10 may additionally (or alternatively) include a MWD survey tool 38*e* at or near the BHA 38. In some embodiments, the MWD survey tool 38*e* includes any of the sensors 38*a*-38*d* as well as combinations of these sensors. The BHA 38 and the MWD portion of the BHA 38 (which portion includes the sensors 38*a-d* and the MWD survey tool 38*e*) may be collectively referred to as a "downhole tool." Alternatively, the BHA 38 and the MWD portion of the BHA 38 may each be individually referred to as a "downhole tool." The MWD survey tool 38*e* may be configured to perform surveys along length of a wellbore, such as during drilling and tripping operations. The data from these surveys may be transmitted by the MWD survey tool 38*e* to the control system 50 through various telemetry methods, such as mud pulses. In addition, or instead, the data from the surveys may be stored within the MWD survey tool 38*e* or an associated memory. In this case, the survey data may be downloaded to the control system 50 when the MWD survey tool 38*e* is removed from the wellbore or at a maintenance facility at a later time. The MWD survey tool 38*e* is discussed further below with reference to FIG. 2.

Finally, the drilling rig 10 may additionally (or alternatively) include any combination of the following: the mud motor ΔP sensor 52*a* and the torque sensor(s) 52*b*. The mud motor ΔP sensor 52*a* is configured to detect a pressure differential value or range across one or more motors 52 of the BHA 38 and may comprise one or more individual pressure sensors and/or a comparison tool. The motor(s) 52 may each be or include a positive displacement drilling motor that uses hydraulic power of the drilling fluid to drive the drill bit 40 (also known as a mud motor). The torque sensor(s) 52*b* may also be included in the BHA 38 for sending data to the control system 50 that is indicative of the torque applied to the drill bit 40 by the motor(s) 52.

Figure 2:
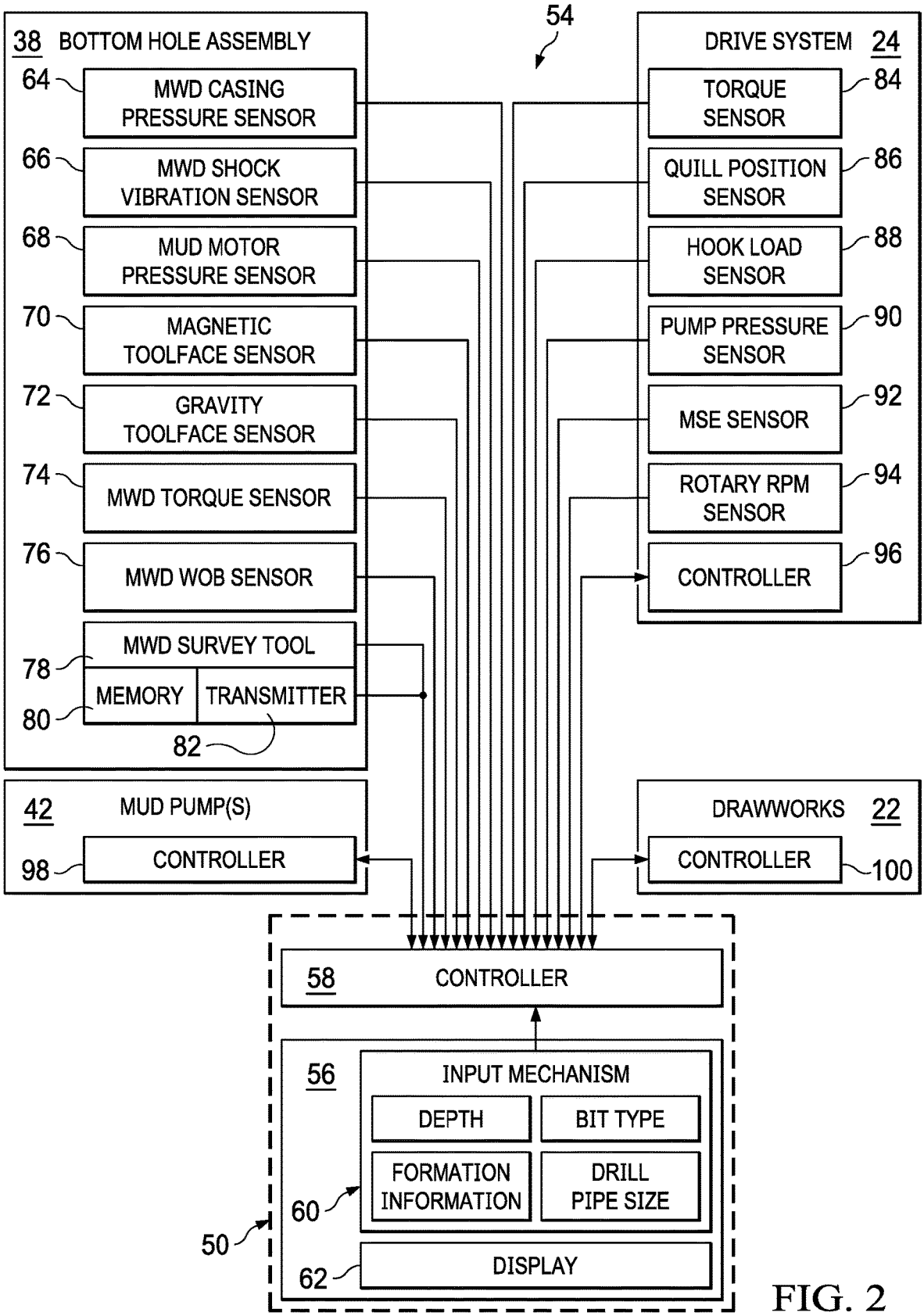
FIG. 2 is a diagrammatic illustration of an apparatus that may be implemented within the environment and/or the drilling rig of FIG. 1, according to one or more embodiments of the present disclosure.
Figure 3A:
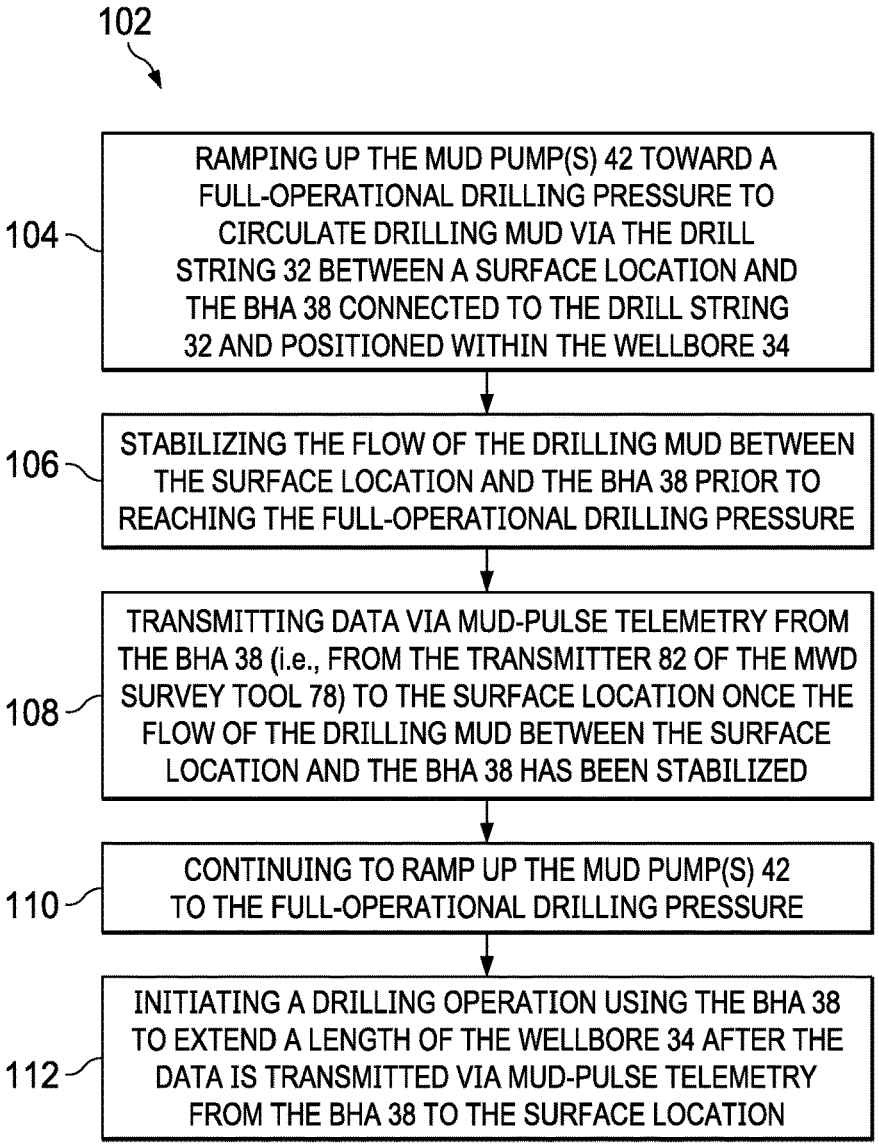
FIG. 3(*a*) is a flow diagram of a method for implementing one or more embodiments of the present disclosure.
Figure 3B:
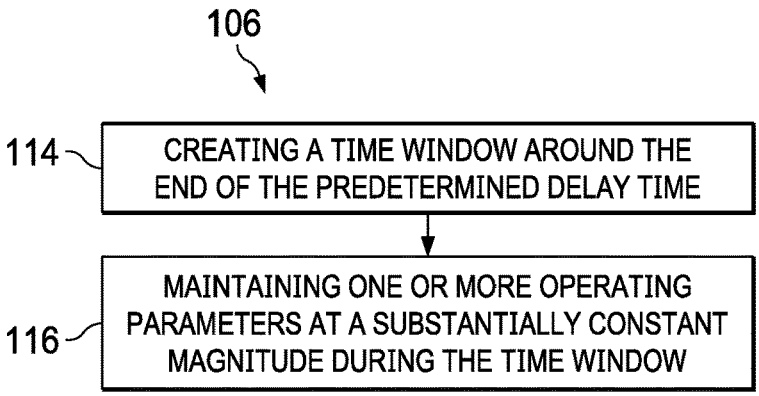
Figure 3C:
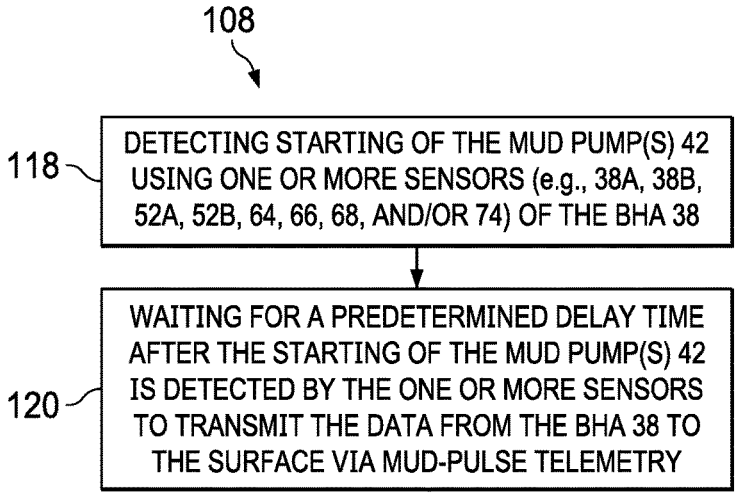
Figure 3D:
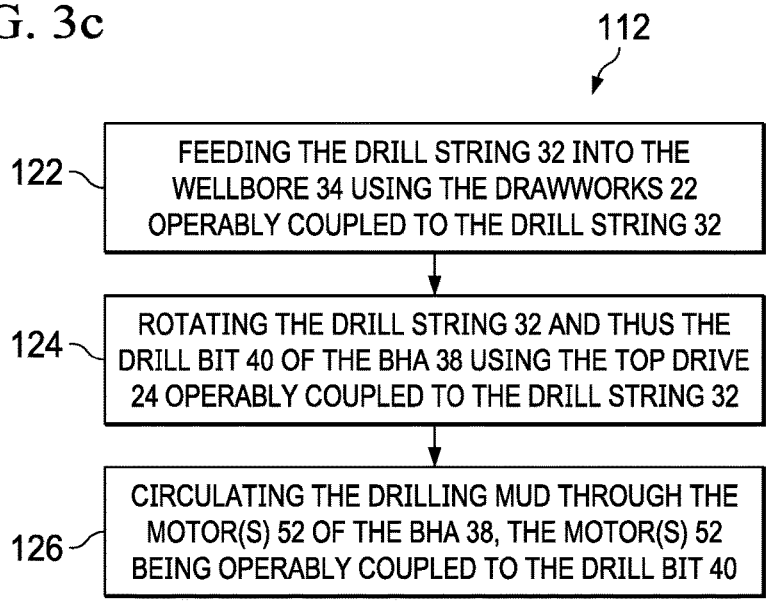

Referring to FIG. 2, an apparatus is diagrammatically shown and generally referred to by the reference numeral 54. The apparatus 54 includes at least respective parts of the drilling rig 10, including, but not limited to, the control system 50, the drawworks 22, the top drive 24 (identified as a "drive system"), the BHA 38, and the mud pump(s) 42. The apparatus 54 may be implemented within the environment and/or the drilling rig 10 of FIG. 1. The drilling rig 10 and the apparatus 54 may be collectively referred to as a "drilling system." As shown in FIG. 2, the control system 50 includes a user-interface 56 and a controller 58—depending on the embodiment, these may be discrete components that are interconnected via a wired or wireless link. The user-interface 56 and the controller 58 may additionally (or alternatively) be integral components of a single system. The user-interface 56 may include an input mechanism 60 that permits a user to input drilling settings or parameters such as, for example, left and right oscillation revolution settings (these settings control the drive system to oscillate a portion of the drill string 32), acceleration, toolface setpoints, rotation settings, a torque target value (such as a previously calculated torque target value that may determine the limits of oscillation), information relating to the drilling parameters of the drill string 32 (such as BHA information or arrangement, drill pipe size, bit type, depth, and formation information), and/or other setpoints and input data.

The input mechanism 60 may include a keypad, voice-recognition apparatus, dial, button, switch, slide selector, toggle, joystick, mouse, database, and/or any other suitable data input device. The input mechanism 60 may support data input from local and/or remote locations. In addition, or instead, the input mechanism 60, when included, may permit user-selection of predetermined profiles, algorithms, setpoint values or ranges, such as via one or more drop-down menus—this data may instead (or in addition) be selected by the controller 58 via the execution of one or more database look-up procedures. In general, the input mechanism 60 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other suitable techniques or systems. The user-interface 56 may also include a display 62 for visually presenting information to the user in textual, graphic, or video form. The display 62 may be utilized by the user to input drilling parameters, limits, or setpoint data in conjunction with the input mechanism 60—for example, the input mechanism 60 may be integral to or otherwise communicably coupled with the display 62. The controller 58 may be configured to receive data or information from the user, the drawworks 22, the top drive 24, the BHA 38, and/or the mud pump(s) 42—the controller 58 processes such data or information to enable effective and efficient drilling.

The BHA 38 includes one or more sensors (typically a plurality of sensors) located and configured about the BHA 38 to detect parameters relating to the drilling environment, the condition and orientation of the BHA 38, and/or other information. For example, the BHA 38 may include an MWD casing pressure sensor 64, an MWD shock/vibration sensor 66, a mud motor ΔP sensor 68, a magnetic toolface sensor 70, a gravity toolface sensor 72, an MWD torque sensor 74, and an MWD weight-on-bit ("WOB") sensor 76—in some embodiments, one or more of these sensors is, includes, or is part of the following sensor(s) shown in FIG. 1: the downhole annular pressure sensor 38*a*, the shock/vibration sensor 38*b*, the toolface sensor 38*c*, the WOB sensor 38*d*, the mud motor ΔP sensor 52*a*, and/or the torque sensor(s) 52*b*.

The MWD casing pressure sensor 64 is configured to detect an annular pressure value or range at or near the MWD portion of the BHA 38. The MWD shock/vibration sensor 66 is configured to detect shock and/or vibration in the MWD portion of the BHA 38. The mud motor ΔP sensor 68 is configured to detect a pressure differential value or range across the mud motor of the BHA 38. The magnetic toolface sensor 70 and the gravity toolface sensor 72 are cooperatively configured to detect the current toolface. In some embodiments, the magnetic toolface sensor 70 is or includes a magnetic toolface sensor that detects toolface orientation relative to magnetic north or true north. In some embodiments, the gravity toolface sensor 72 is or includes a gravity toolface sensor that detects toolface orientation relative to the Earth's gravitational field. In some embodiments, the magnetic toolface sensor 70 detects the current toolface when the end of the wellbore 34 is less than about 7° from vertical, and the gravity toolface sensor 72 detects the current toolface when the end of the wellbore 34 is greater than about 7° from vertical. Other toolface sensors may also be utilized within the scope of the present disclosure that may be more or less precise (or have the same degree of precision), including non-magnetic toolface sensors and non-gravitational inclination sensors. The MWD torque sensor 74 is configured to detect a value or range of values for torque applied to the bit by the motor(s) of the BHA 38. The MWD weight-on-bit ("WOB") sensor 76 is configured to detect a value (or range of values) for WOB at or near the BHA 38.

The following data may be sent to the controller 58 via one or more signals, such as, for example, electronic signal via wired or wireless transmission, mud-pulse telemetry, another signal, or any combination thereof: the casing pressure data detected by the MWD casing pressure sensor 64, the shock/vibration data detected by the MWD shock/vibration sensor 66, the pressure differential data detected by the mud motor ΔP sensor 68, the toolface orientation data detected by the toolface sensors 70 and 72, the torque data detected by the MWD torque sensor 74, and/or the WOB data detected by the MWD WOB sensor 76. The pressure differential data detected by the mud motor ΔP sensor 68 may alternatively (or additionally) be calculated, detected, or otherwise determined at the surface, such as by calculating the difference between the surface standpipe pressure just off-bottom and the pressure measured once the bit touches bottom and starts drilling and experiencing torque.

The BHA 38 may also include a MWD survey tool 78—in some embodiments, the MWD survey tool 78 is, includes, or is part of the MWD survey tool 38*e* shown in FIG. 1. The MWD survey tool 78 may be configured to perform surveys at intervals along the wellbore 34, such as during drilling and tripping operations. The MWD survey tool 78 may include one or more gamma ray sensors that detect gamma data. The data from these surveys may be transmitted by the MWD survey tool 78 to the controller 58 through various telemetry methods, such as mud pulses. In other embodiments, survey data is collected and stored by the MWD survey tool 78 in an associated memory 80. This data may be uploaded to the controller 58 at a later time, such as when the MWD survey tool 78 is removed from the wellbore 34 or during maintenance. Some embodiments use alternative data gathering sensors or obtain information from other sources. For example, the BHA 38 may include sensors for making additional measurements, including, for example and without limitation, azimuthal gamma data, neutron density, porosity, and resistivity of surrounding formations. In some embodiments, such information may be obtained from third parties or may be measured by systems other than the BHA 38.

The BHA 38 may include a memory 80 and a transmitter 82. In some embodiments, the memory 80 and transmitter 82 are integral parts of the MWD survey tool 78, while in other embodiments, the memory 80 and transmitter 82 are separate and distinct modules. The memory 80 may be any type of memory device, such as a cache memory (e.g., a cache memory of the processor), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, or other forms of volatile and non-volatile memory. The memory 80 may be configured to store readings and measurements for some period of time. In some embodiments, the memory 80 is configured to store the results of surveys performed by the MWD survey tool 78 for some period of time, such as the time between drilling connections, or until the memory 80 may be downloaded after a tripping out operation. The transmitter 82 may be any type of device to transmit data from the BHA 38 to the controller 58, and may include a mud pulse transmitter. In some embodiments, the MWD survey tool 78 is configured to transmit survey results in real-time to the surface through the transmitter 82. In other embodiments, the MWD survey tool 78 is configured to store survey results in the memory 80 for a period of time, access the survey results from the memory 80, and transmit the results to the controller 58 through the transmitter 82.

The top drive 24 includes one or more sensors (typically a plurality of sensors) located and configured about the top drive 24 to detect parameters relating to the condition and orientation of the drill string 32, and/or other information. For example, the top drive 24 may include a rotary torque sensor 84, a quill position sensor 86, a hook load sensor 88, a pump pressure sensor 90, a mechanical specific energy ("MSE") sensor 92, and a rotary RPM sensor 94—in some embodiments, one or more of these sensors is, includes, or is part of the following sensor shown in FIG. 1: the torque sensor 24*a*, the speed sensor 24*b*, the WOB sensor 24*c*, and/or the casing annular pressure sensor 48. The top drive 24 also includes a controller 96 for controlling the rotational position, speed, and direction of the quill 28 and/or another component of the drill string 32 coupled to the top drive 24—in some embodiments, the controller 96 is, includes, or is part of the controller 58.

The rotary torque sensor 84 is configured to detect a value (or range of values) for the reactive torsion of the quill 28 or the drill string 32. The quill position sensor 86 is configured to detect a value (or range of values) for the rotational position of the quill 28 (e.g., relative to true north or another stationary reference). The hook load sensor 88 is configured to detect the load on the hook 26 as it suspends the top drive 24 and the drill string 32. The pump pressure sensor 90 is configured to detect the pressure of the mud pump(s) 42 providing mud or otherwise powering the BHA 38 from the surface. In some embodiments, rather than being included as part of the top drive 24, the pump pressure sensor 90 may be incorporated into, or included as part of, the mud pump(s) 42. The MSE sensor 92 is configured to detect the MSE representing the amount of energy required per unit volume of drilled rock—in some embodiments, the MSE is not directly detected, but is instead calculated at the controller 58 (or another controller) based on sensed data. The rotary RPM sensor 94 is configured to detect the rotary RPM of the drill string 32—this may be measured at the top drive 24 or elsewhere (e.g., at surface portion of the drill string 32). The following data may be sent to the controller 58 via one or more signals, such as, for example, electronic signal via wired or wireless transmission: the rotary torque data detected by the rotary torque sensor 84, the quill position data detected by the quill position sensor 86, the hook load data detected by the hook load sensor 88, the pump pressure data detected by the pump pressure sensor 90, the MSE data detected (or calculated) by the MSE sensor 92, and/or the RPM data detected by the RPM sensor 88.

The mud pump(s) 42 include a controller 98 and/or other means for controlling the pressure and flow rate of the drilling mud produced by the mud pump(s) 42—such control may include torque and speed control of the mud pump(s) 42 to manipulate the pressure and flow rate of the drilling mud and the ramp-up or ramp-down rates of the mud pump(s) 42. In some embodiments, the controller 98 is, includes, or is part of the controller 58.

The drawworks 22 include a controller 100 and/or other means for controlling feed-out and/or feed-in of the drilling line 20 (shown in FIG. 1)—such control may include rotational control of the drawworks to manipulate the height or position of the hook and the rate at which the hook ascends or descends. The drill string feed-off system of the drawworks 22 may instead be a hydraulic ram or rack and pinion type hoisting system rig, where the movement of the drill string 32 up and down is facilitated by something other than a drawworks. The drill string 32 may also take the form of coiled tubing, in which case the movement of the drill string 32 in and out of the wellbore 34 is controlled by an injector head which grips and pushes/pulls the tubing in/out of the wellbore 34. Such embodiments still include a version of the controller 100 configured to control feed-out and/or feed-in of the drill string 32. In some embodiments, the controller 100 is, includes, or is part of the controller 58.

The controller 58 may be configured to receive data or information relating to one or more of the above-described parameters from the user-interface 56, the BHA 38 (including the MWD survey tool 78), the top drive 24, the mud pump(s) 42, and/or the drawworks 22, as described above, and to utilize such information to enable effective and efficient drilling. In some embodiments, the parameters are transmitted to the controller 58 by one or more data channels. In some embodiments, each data channel may carry data or information relating to a particular sensor. The controller 58 may be further configured to generate a control signal, such as via intelligent adaptive control, and provide the control signal to the top drive 24, the mud pump(s) 42, and/or the drawworks 22 to adjust and/or maintain one or more of the following: the rotational position, speed, and direction of the quill 28 and/or another component of the drill string 32 coupled to the top drive 24, the pressure and flow rate of the drilling mud produced by the mud pump(s) 42, and the feed-out and/or feed-in of the drilling line 20. Moreover, the controller 96 of the top drive 24, the controller 98 of the mud pump(s) 42, and/or the controller 100 of the drawworks 22 may be configured to generate and transmit a signal to the controller 58—these signal(s) influence the control of the top drive 24, the mud pump(s) 42, and/or the drawworks 22. In addition, or instead, any one of the controllers 96, 98, and 100 may be configured to generate and transmit a signal to another one of the controllers 96, 98, or 100, whether directly or via the controller 58—as a result, any combination of the controllers 96, 98, and 100 may be configured to cooperate in controlling the top drive 24, the mud pump(s) 42, and/or the drawworks 22.

In operation, the drilling rig 10 and/or the apparatus 54 are utilized to drill stands down one after the other in order to advance the drill string 32 and the wellbore 34 in accordance with the well plan. To begin the process of drilling down a particular stand, the stand is connected at the top of the drill string 32 on the rig floor 14. Moreover, the top drive 24 is connected to an upper end portion of the made-up stand. The mud pump(s) 42 are started to initiate the flow of drilling mud into the made-up stand and the drill string 32. Before, during, or after the starting of the mud pump(s) 42, the drawworks 22 are used to reel in the drilling line 20 so that the drill string 32 is lifted out of slips—thereafter, the drilling line 20 is reeled out to lower the BHA 38 to the bottom of the wellbore 34. Before, during, or after the lowering of the BHA 38 to the bottom of the wellbore 34, the mud pump(s) 42 are ramped up (e.g., in one or more stages) to circulate drilling mud downhole through the drill string 32 to the BHA 38 and uphole in an annulus between the drill string 32 and the wellbore 34 to the surface. Alternatively, the drilling mud may be circulated downhole in the annulus between the drill string 32 and the wellbore 34 to the BHA 38 and uphole through the drill string 32 to the surface. During or after the ramping up of the mud pump(s) 42, drilling is initiated by rotating the top drive 24 (for rotary drilling) and/or rotating the motor(s) 52 of the BHA 38 (for slide drilling) to thereby rotate the drill bit 40. However, to increase the likelihood of proper decoding of any transmitted data from a survey, smooth and steady fluid flow is desirable.

To avoid delays associated with waiting for the mud pump(s) 42 to be fully ramped up before transmitting the survey from the BHA 38 to the surface, some embodiments of the system herein include operating the BHA 38 to transmit the survey to the surface via mud-pulse telemetry during the ramping up of the mud pump(s) 42. More particularly, the BHA 38 is configured to detect when the mud pump(s) 42 have been turned on and to wait a predetermined "survey delay time" thereafter before transmitting the survey to the surface via mud-pulse telemetry—one or more of the following sensors (or a combination thereof) may be used to detect when the mud pump(s) 42 have been turned on: the downhole annular pressure sensor 38*a*, the shock/vibration sensor 38*b*, the mud motor delta pressure ("ΔP") sensor 52*a*, the one or more torque sensors 52*b*, the MWD casing pressure sensor 64, the MWD shock/vibration sensor 66, the mud motor ΔP sensor 68, and/or the MWD torque sensor 74. The survey delay time may be predetermined based on one or more characteristics of the drawworks 22, the top drive 24, the BHA 38, the mud pump(s) 42, one or more other characteristics of the drilling rig 10 or the apparatus 54, and/or other factor(s).

The drilling rig control system 50 (either alone or in combination with the controllers 96, 98, and/or 100) is configured to create a time window encompassing the end of this survey delay time in which the drawworks 22, the top drive 24, and/or the mud pump(s) 42 are controlled in a manner that stabilizes the flow of the drilling mud to prevent, or at least reduce, poor decoding of the mud-pulse telemetry data (i.e., the survey) from the BHA 38. During this time window, the control system 50 manages the drawworks 22, the top drive 24, and/or the mud pump(s) 42 by maintaining one or more of the following operating parameters (or a combination thereof) at a constant magnitude: the speed of the mud pump(s) 42 (e.g., in strokes-per-minute or "spm"), the flow rate at which the drilling mud is pumped by the mud pump(s) 42 (e.g., in gallons-per-minute or "gpm"), the pressure at which the drilling mud is pumped by the mud pump(s) 42 (e.g., in pounds-per-square-inch or "psi"), the rate at which the mud pump(s) 42 are ramped up (e.g., in spm^2), the speed at which the top drive 24 rotates the drill string 32 (e.g., in revolutions-per-minute or "RPM"), the rate at which the top drive 24 is ramped up (e.g., in RPM^2), and/or the speed at which the drawworks 22 feeds the drill string 32 (e.g., in feet-per-hour or "ft/hr") into the wellbore 34.

Referring to FIG. 3(*a*), a method is diagrammatically illustrated and generally referred to by the reference numeral 102. In an embodiment, the method 102 includes ramping up the mud pump(s) 42 toward a full-operational pumping pressure to circulate drilling mud via the drill string 32 between a surface location and the BHA 38 connected to the drill string 32 and positioned within the wellbore 34 at a step 104, and stabilizing the flow of the drilling mud between the surface location and the BHA 38 prior to reaching the full-operational pumping pressure during the ramping up of the mud pump(s) 42 at a step 106. Turning to FIG. 3(*b*), in some embodiments, the step 106 includes creating a time window encompassing the expiration of the predetermined survey delay time at a step 114, and maintaining one or more operating parameters at a substantially constant magnitude during the time window at a step 116. In some embodiments, the one or more operating parameters that are maintained at the substantially constant magnitude during the time window comprise at least one of: a speed of the mud pump(s) 42, a flow rate at which the drilling mud is pumped between the surface location and the BHA 38 by the mud pump(s) 42, a pressure at which the drilling mud is pumped by the mud pump(s) 42, a rate at which the mud pump(s) 42 are ramped up, a speed at which a top drive 24 operably coupled to the drill string 32 rotates the drill string 32, a rate at which the top drive 24 is ramped up, or a speed at which a drawworks 22 operably coupled to the drill string 32 feeds the drill string 32 into the wellbore 34.

Referring back to FIG. 3(*a*), in some embodiments, the method 102 further includes transmitting data via mud-pulse telemetry from the BHA 38 (i.e., from the transmitter 82 of the MWD survey tool 78) to the surface location once the flow of the drilling mud between the surface location and the BHA 38 has been stabilized at a step 108. Turning to FIG. 3(*c*), in some embodiments, the step 108 includes detecting starting of the mud pump(s) 42 using one or more sensors (e.g., 38*a*, 38*b*, 52*a*, 52*b*, 64, 66, 68, and/or 74) of the BHA 38 at a step 118, and waiting for a predetermined delay time after the starting of the mud pump(s) 42 is detected by the one or more sensors to transmit the data from the BHA 38 to the surface via mud-pulse telemetry at a step 120.

Referring again to FIG. 3(*a*), in some embodiments, the method 102 further includes continuing to ramp up the mud pump(s) 42 to the full-operational pumping pressure at a step 110, and initiating a drilling operation using the BHA 38 to extend a length of the wellbore 34 after the data is transmitted via mud-pulse telemetry from the BHA 38 to the surface location at a step 112. Turning to FIG. 3(*d*), in some embodiments, the step 112 may include feeding the drill string 32 into the wellbore 34 using the drawworks 22 operably coupled to the drill string 32 at a step 122, rotating the drill string 32 and thus the drill bit 40 of the BHA 38 using the top drive 24 operably coupled to the drill string 32 at a step 124, and circulating the drilling mud through the motor(s) 52 of the BHA 38, the motor(s) 52 being operably coupled to the drill bit 40 at a step 126.

Figure 4:
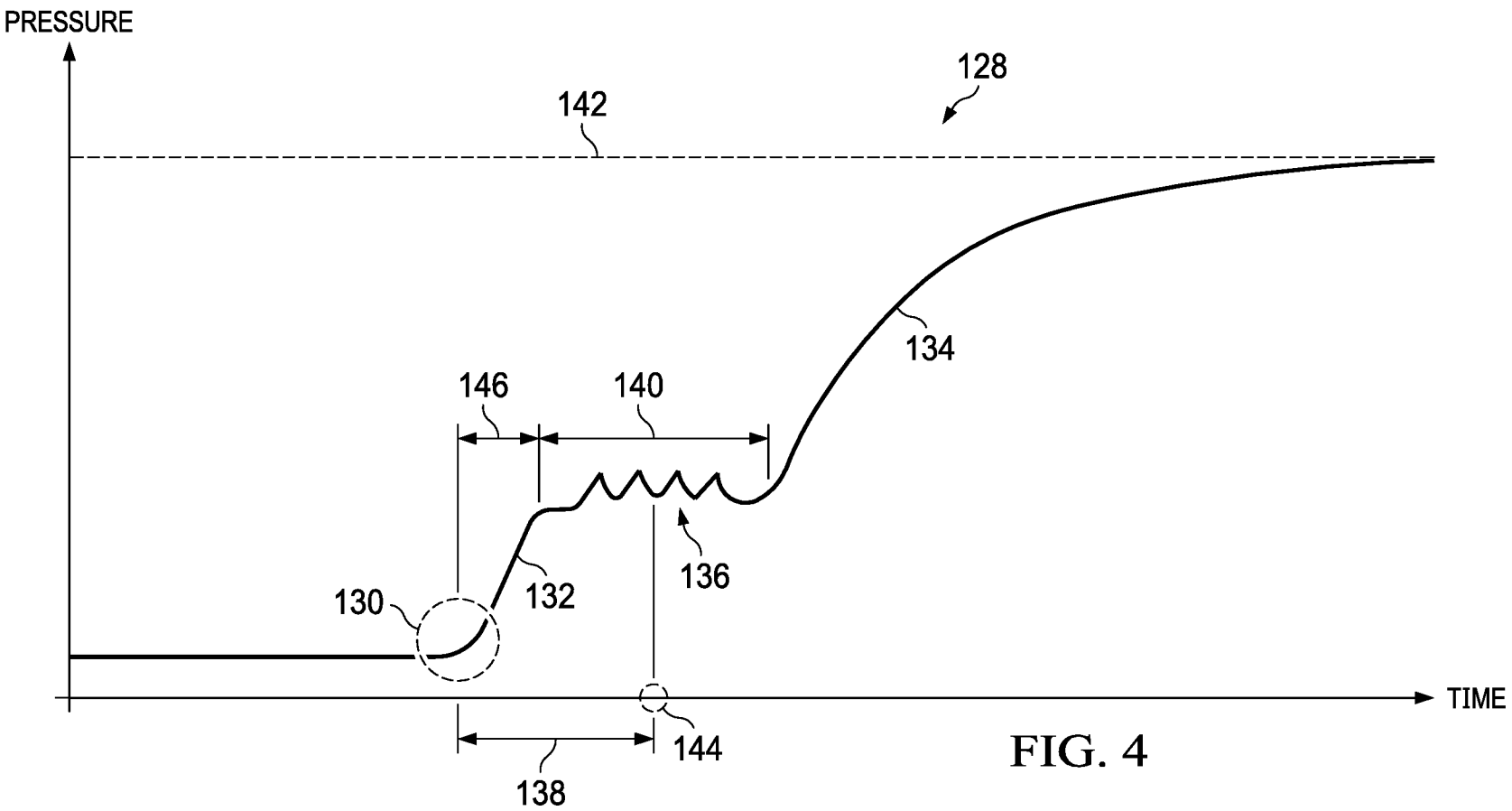
FIG. 4 is a graphical illustration representing the method of FIGS. 3(*a*)-3(*d*), according to one or more embodiments of the present disclosure.

Referring to FIG. 4, a waveform is graphically illustrated and generally referred to by the reference numeral 128—the waveform 128 shows the pressure (e.g., in psi) generated by the mud pump(s) 142 over time during the execution of the method 102. The waveform 128 includes an inflection point 130, ramped portions 132 and 134, a synch 136, a delay time 138, and a time window 140. The inflection point 130 represents starting of the mud pump(s) 42 to initiate flow of a drilling mud into the drill string 32 that extends within the wellbore 34. The ramped portions 132 and 134 represent the execution of the steps 104 and 110 of ramping up the mud pump(s) 42 toward a full-operational pumping pressure to circulate drilling mud via the drill string 32 between a surface location and the BHA 38, and continuing to ramp up the mud pump(s) 42 to the full-operational pumping pressure. The full-operational pumping pressure of the mud pump(s) 42 is represented by a dashed line in FIG. 4 and referred to by the reference numeral 142. The synch 136 represents the execution of the steps 106 and 108 of stabilizing the flow of the drilling mud between the surface location and the BHA 38 prior to reaching the full-operational pumping pressure during the ramping up of the mud pump(s) 42, and transmitting data via mud-pulse telemetry from the BHA 38 to the surface location once the flow of the drilling mud between the surface location and the BHA 38 has been stabilized.

The delay time 138 represents the execution of the steps 118 and 120 of detecting the starting of the mud pump(s) 42 using one or more sensors (e.g., 38*a*, 38*b*, 52*a*, 52*b*, 64, 66, 68, and/or 74) of the BHA 38, and waiting for a predetermined delay time after the starting of the mud pump(s) 42 is detected by the one or more sensors to transmit the data from the BHA 38 to the surface via mud-pulse telemetry. The expiration of the predetermined survey delay time is indicated by the reference numeral 144—as shown in FIG. 4, the end 144 of the predetermined delay time falls within the time window 140. The time window 140 represents the execution of the steps 114 and 116 of creating a time window encompassing the expiration of the predetermined survey delay time, and maintaining one or more operating parameters at a substantially constant magnitude during the time window. The time span between the starting of the mud pump(s) 142 and the beginning of the time window 140 is represented by an arrow in FIG. 4 and referred to by the reference numeral 146—as shown in FIG. 4, the time span 146 is shorter than the delay time 138. In some embodiments, the time span 146 is roughly equal to the delay time 138 minus one-half of the time window 140.

Figure 5:
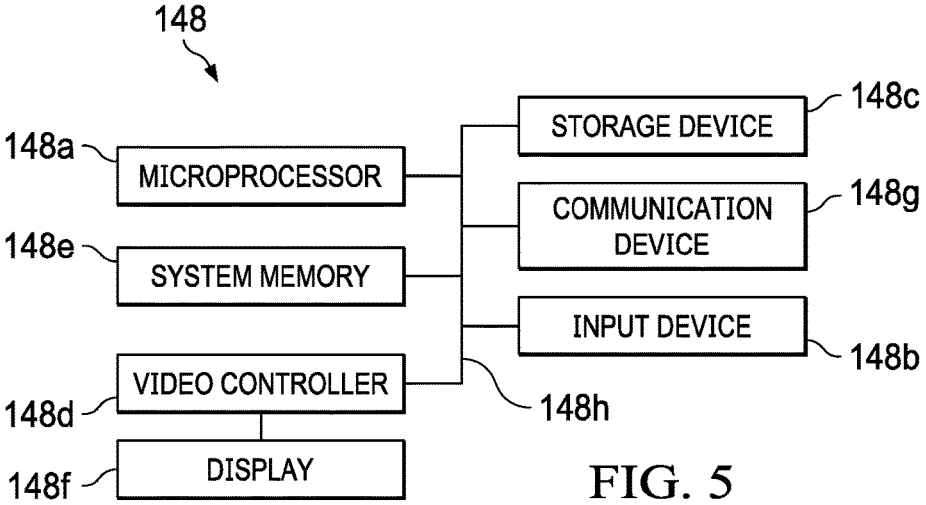
FIG. 5 is a diagrammatic illustration of a computing device for implementing one or more embodiments of the present disclosure.

Referring to FIG. 5, an embodiment of a computing device 148 for implementing one or more embodiments of one or more of the above-described controllers (e.g., 58, 96, 98, or 100), control systems (e.g., 50), methods (e.g., 102), and/or steps (e.g., 104, 106, 108, 110, 112, 114, 116, 118, 120, 122, 124, or 126), and/or any combination thereof, is depicted. The computing device 148 includes a microprocessor 148*a*, an input device 148*b*, a storage device 148*c*, a video controller 148*d*, a system memory 148*e*, a display 148*f*, and a communication device 148*g* all interconnected by one or more buses 148*h*. In some embodiments, the storage device 148*c* may include a floppy drive, hard drive, CD-ROM, optical drive, any other form of storage device and/or any combination thereof. In some embodiments, the storage device 148*c* may include, and/or be capable of receiving, a floppy disk, CD-ROM, DVD-ROM, or any other form of computer-readable medium that may contain executable instructions. In some embodiments, the communication device 148*g* may include a modem, network card, or any other device to enable the computing device to communicate with other computing devices. In some embodiments, any computing device represents a plurality of interconnected (whether by intranet or Internet) computer systems, including without limitation, personal computers, mainframes, PDAs, smartphones and cell phones.

The computing device can send a network message using proprietary protocol instructions to render 3D models and/or medical data. The link between the computing device and the display unit and the synchronization between the programmed state of physical manikin and the rendering data/3D model on the display unit of the present invention facilitate enhanced learning experiences for users. In this regard, multiple display units can be used simultaneously by multiple users to show the same 3D models/data from different points of view of the same manikin(s) to facilitate uniform teaching and learning, including team training aspects.

In some embodiments, one or more of the components of the above-described embodiments include at least the computing device 148 and/or components thereof, and/or one or more computing devices that are substantially similar to the computing device 148 and/or components thereof. In some embodiments, one or more of the above-described components of the computing device 148 include respective pluralities of same components.

In some embodiments, a computer system typically includes at least hardware capable of executing machine readable instructions, as well as the software for executing acts (typically machine-readable instructions) that produce a desired result. In some embodiments, a computer system may include hybrids of hardware and software, as well as computer sub-systems.

In some embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In some embodiments, hardware may include any physical device that is capable of storing machine-readable instructions, such as memory or other data storage devices. In some embodiments, other forms of hardware include hardware sub-systems, including transfer devices such as modems, modem cards, ports, and port cards, for example.

In some embodiments, software includes any machine code stored in any memory medium, such as RAM or ROM, and machine code stored on other devices (such as floppy disks, flash memory, or a CD ROM, for example). In some embodiments, software may include source or object code. In some embodiments, software encompasses any set of instructions capable of being executed on a computing device such as, for example, on a client machine or server.

In some embodiments, combinations of software and hardware could also be used for providing enhanced functionality and performance for certain embodiments of the present disclosure. In an embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In some embodiments, computer readable mediums include, for example, passive data storage, such as a random access memory (RAM) as well as semi-permanent data storage such as a compact disk read only memory (CD-ROM). One or more embodiments of the present disclosure may be embodied in the RAM of a computer to transform a standard computer into a new specific computing machine. In some embodiments, data structures are defined organizations of data that may enable an embodiment of the present disclosure. In an embodiment, a data structure may provide an organization of data, or an organization of executable code.

In some embodiments, any networks and/or one or more portions thereof, may be designed to work on any specific architecture. In an embodiment, one or more portions of any networks may be executed on a single computer, local area networks, client-server networks, wide area networks, internets, hand-held and other portable and wireless devices and networks.

In some embodiments, a database may be any standard or proprietary database software. In some embodiments, the database may have fields, records, data, and other database elements that may be associated through database specific software. In some embodiments, data may be mapped. In some embodiments, mapping is the process of associating one data entry with another data entry. In an embodiment, the data contained in the location of a character file can be mapped to a field in a second table. In some embodiments, the physical location of the database is not limiting, and the database may be distributed. In an embodiment, the database may exist remotely from the server, and run on a separate platform. In an embodiment, the database may be accessible across the Internet. In some embodiments, more than one database may be implemented.

In some embodiments, a plurality of instructions stored on a non-transitory computer readable medium may be executed by one or more processors to cause the one or more processors to carry out or implement in whole or in part the above-described operation of each of the above-described embodiments of the drilling rig 10 and/or the apparatus 54, and/or any combination thereof. In some embodiments, such a processor may include the microprocessor 148*a*, and such a non-transitory computer readable medium may include the storage device 148*c*, the system memory 148*e*, or a combination thereof. Moreover, the computer readable medium may be distributed among one or more components of the drilling rig 10, the apparatus 54, and/or the controllers 58, 96, 98, or 100, and/or any combination thereof. In some embodiments, such a processor may execute the plurality of instructions in connection with a virtual computer system. In some embodiments, such a plurality of instructions may communicate directly with the one or more processors, and/or may interact with one or more operating systems, middleware, firmware, other applications, and/or any combination thereof, to cause the one or more processors to execute the instructions.

The present disclosure introduces a method including ramping up one or more mud pumps toward a full-operational pumping pressure to circulate drilling mud via a drill string between a surface location and a downhole tool, the downhole tool being connected to the drill string and positioned within a wellbore; stabilizing the flow of the drilling mud between the surface location and the downhole tool prior to the one or more mud pumps reaching the full-operational pumping pressure; transmitting data via mud-pulse telemetry from the downhole tool to the surface location when the flow of the drilling mud between the surface location and the downhole tool is stabilized; and continuing to ramp up the one or more mud pumps to the full-operational pumping pressure. In some embodiments, transmitting the data via mud-pulse telemetry from the downhole tool to the surface location when the flow of the drilling mud between the surface location and the downhole tool is stabilized includes detecting, using one or more sensors of the downhole tool, an operation of the one or more mud pumps; and waiting a predetermined delay time after the operation of the one or more mud pumps is detected by the one or more sensors to transmit the data from the downhole tool to the surface location via mud-pulse telemetry. In some embodiments, stabilizing the flow of the drilling mud between the surface location and the downhole tool prior to the one or more mud pumps reaching the full-operational pumping pressure includes creating a time window encompassing the expiration of the predetermined survey delay time; and maintaining one or more operating parameters at a substantially constant magnitude during the time window. In some embodiments, the one or more operating parameters that are maintained at the substantially constant magnitude during the time window include at least one of: a speed of at least one of the one or more mud pumps; a flow rate at which the drilling mud is pumped between the surface location and the downhole tool by the one or more mud pumps; a pressure at which the drilling mud is pumped by the one or more mud pumps; or a rate at which at least one of the one or more mud pumps is ramped up. In some embodiments, the method further includes initiating a drilling operation to extend a length of the wellbore using the downhole tool and a drawworks operably coupled to the drill string, wherein the one or more operating parameters that are maintained at the substantially constant magnitude during the time window include at least one of: a speed of at least one of the one or more mud pumps; a flow rate at which the drilling mud is pumped between the surface location and the downhole tool by the one or more mud pumps; a pressure at which the drilling mud is pumped by the one or more mud pumps; a rate at which at least one of the one or more mud pumps is ramped up; or a speed at which the drawworks feeds the drill string into the wellbore. In some embodiments, the method further includes initiating a drilling operation to extend a length of the wellbore using the downhole tool and at least one of: a drive system operably coupled to the drill string and adapted to rotate the drill string and thus a drill bit of the downhole tool; or one or more motors of the downhole tool through which the drilling mud is adapted to be circulated to rotate the drilling bit; wherein the one or more operating parameters that are maintained at the substantially constant magnitude during the time window include at least one of: a speed of at least one of the one or more mud pumps; a flow rate at which the drilling mud is pumped between the surface location and the downhole tool by the one or more mud pumps; a pressure at which the drilling mud is pumped by the one or more mud pumps; a rate at which at least one of the one or more mud pumps is ramped up; a speed at which the drive system rotates the drill string; a rate at which the drive system is ramped up; or a speed at which the drawworks feeds the drill string into the wellbore.

The present disclosure also introduces a system including a downhole tool connected to a drill string and positioned within a wellbore; one or more mud pumps adapted to ramp up toward a full-operational pumping pressure to circulate a drilling mud via the drill string between a surface location and the downhole tool; and a control system adapted to cause the flow of the drilling mud between the surface location and the downhole tool to stabilize prior to the one or more mud pumps reaching the full-operational pumping pressure; wherein the downhole tool is adapted to transmit data via mud-pulse telemetry to the surface location when the flow of the drilling mud between the surface location and the downhole tool is stabilized by the control system. In some embodiments, the downhole tool includes one or more sensors adapted to detect an operation of the one or more mud pumps, the downhole tool being adapted to wait a predetermined delay time after the operation of the one or more mud pumps is detected by the one or more sensors to transmit the data to the surface location via mud-pulse telemetry. In some embodiments, to cause the flow of the drilling mud between the surface location and the downhole tool to stabilize prior to the one or more mud pumps reaching the full-operational pumping pressure, the control system is adapted to: create a time window encompassing the expiration of the predetermined survey delay time; and maintain one or more operating parameters at a substantially constant magnitude during the time window. In some embodiments, the one or more operating parameters that are maintained at the substantially constant magnitude during the time window include at least one of: a speed of at least one of the one or more mud pumps; a flow rate at which the drilling mud is pumped between the surface location and the downhole tool by the one or more mud pumps; a pressure at which the drilling mud is pumped by the one or more mud pumps; or a rate at which at least one of the one or more mud pumps is ramped up. In some embodiments, the system further includes a drawworks operably coupled to the drill string, wherein the one or more operating parameters that are maintained at the substantially constant magnitude during the time window include at least one of: a speed of at least one of the one or more mud pumps; a flow rate at which the drilling mud is pumped between the surface location and the downhole tool by the one or more mud pumps; a pressure at which the drilling mud is pumped by the one or more mud pumps; a rate at which at least one of the one or more mud pumps is ramped up; or a speed at which the drawworks feeds the drill string into the wellbore. In some embodiments, system further includes at least one of: a drive system operably coupled to the drill string and adapted to rotate the drill string and thus a drill bit of the downhole tool; or one or more motors of the downhole tool through which the drilling mud is adapted to be circulated to rotate the drilling bit; wherein the one or more operating parameters that are maintained at the substantially constant magnitude during the time window include at least one of: a speed of at least one of the one or more mud pumps; a flow rate at which the drilling mud is pumped between the surface location and the downhole tool by the one or more mud pumps; a pressure at which the drilling mud is pumped by the one or more mud pumps; a rate at which at least one of the one or more mud pumps is ramped up; a speed at which the drive system rotates the drill string; a rate at which the drive system is ramped up; or a speed at which the drawworks feeds the drill string into the wellbore.

The present disclosure also introduces a method including transmitting, using a downhole tool, data from a wellbore to a surface location via mud-pulse telemetry upon expiration of a predetermined time delay; pumping, using a mud pump, drilling mud via a drill string between the surface location and the downhole tool; and controlling, using a control system, the mud pump to stabilize the flow of the drilling mud during a time window that encompasses the expiration of the predetermined time delay so that the downhole tool transmits the data to the surface location during the stabilized flow. In some embodiments, before transmitting, using the downhole tool, data from the wellbore to the surface location via mud-pulse telemetry upon expiration of the predetermined time delay the method further includes detecting, using one or more sensors of the downhole tool, an operation of the mud pump; and beginning the predetermined time delay after detecting the operation of the mud pump. In some embodiments, the one or more sensors include at least one of: a pressure sensor; a flow sensor; a shock/vibration sensor; or a torque sensor. In some embodiments, before controlling, using a control system, the mud pump to stabilize the flow of the drilling mud during the time window, the method further includes beginning the time window after a period of time has passed from when the operation of the mud pump starts. In some embodiments, the method further includes synchronizing the downhole tool and the control system so that: the mud pump stabilizes the flow of the drilling mud in the drill string during the time window, and the predetermined time delay stored by the downhole tool expires during the time window.

The present disclosure also introduces a system including a downhole tool storing a predetermined time delay and being adapted to transmit data from a wellbore to a surface location via mud-pulse telemetry upon expiration of the predetermined time delay; a mud pump adapted to circulate a drilling mud via a drill string between a surface location and the downhole tool; and a control system storing a time window that encompasses the expiration of the predetermined time delay, the control system being adapted to control the mud pump to stabilize the flow of the drilling mud during the time window so that the downhole tool transmits the data to the surface location during the stabilized flow. In some embodiments, the downhole tool is configured to begin the predetermined time delay when the downhole tool detects an operation of the mud pump. In some embodiments, the downhole tool includes one or more sensors configured to detect the operation of the mud pump, the one or more sensors including at least one of: a pressure sensor; a flow sensor; a shock/vibration sensor; or a torque sensor. In some embodiments, the control system is configured to begin the time window after a period of time has passed from when the operation of the mud pump starts. In some embodiments, the downhole tool and the control system are synchronized so that: the mud pump stabilizes the flow of the drilling mud in the drill string during the time window, and the predetermined time delay stored by the downhole tool expires during the time window.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method, comprising:

ramping up one or more mud pumps toward a full-operational pumping pressure to circulate drilling mud via a drill string between a surface location and a downhole tool, the downhole tool being connected to the drill string and positioned within a wellbore;

stabilizing a flow of the drilling mud between the surface location and the downhole tool after said ramping up the one or more mud pumps toward the full-operational pumping pressure but prior to the one or more mud pumps reaching the full-operational pumping pressure;

transmitting data via mud-pulse telemetry from the downhole tool to the surface location after said stabilizing the flow of the drilling mud between the surface location and the downhole tool and while the stabilized flow of the drilling mud is maintained; and continuing to ramp up the one or more mud pumps to the full-operational pumping pressure after said transmitting the data via the mud-pulse telemetry from the downhole tool to the surface location;

wherein said transmitting the data via the mud-pulse telemetry from the downhole tool to the surface location after said stabilizing the flow of the drilling mud between the surface location and the downhole tool and while the stabilized flow of the drilling mud is maintained comprises:

detecting, using one or more sensors of the downhole tool, an operation of the one or more mud pumps; and waiting a predetermined delay time after the operation of the one or more mud pumps is detected by the one or more sensors to transmit the data from the downhole tool to the surface location via the mud-pulse telemetry;

and wherein said stabilizing the flow of the drilling mud between the surface location and the downhole tool after said ramping up the one or more mud pumps toward the full-operational pumping pressure but prior to the one or more mud pumps reaching the full-operational pumping pressure comprises:

creating a time window encompassing an expiration of the predetermined delay time; and maintaining one or more operating parameters at a substantially constant magnitude during the time window.

2. The method of claim 1, wherein the one or more operating parameters that are maintained at the substantially constant magnitude during the time window comprise at least one of:

a speed of at least one of the one or more mud pumps;

a flow rate at which the drilling mud is pumped between the surface location and the downhole tool by the one or more mud pumps;

a pressure at which the drilling mud is pumped by the one or more mud pumps; or a rate at which at least one of the one or more mud pumps is ramped up.

3. The method of claim 1, further comprising initiating a drilling operation to extend a length of the wellbore using the downhole tool and a drawworks operably coupled to the drill string, wherein the one or more operating parameters that are maintained at the substantially constant magnitude during the time window comprise at least one of:

a speed of at least one of the one or more mud pumps;

a flow rate at which the drilling mud is pumped between the surface location and the downhole tool by the one or more mud pumps;

a pressure at which the drilling mud is pumped by the one or more mud pumps;

a rate at which at least one of the one or more mud pumps is ramped up; or a speed at which the drawworks feeds the drill string into the wellbore.

4. The method of claim 1, further comprising initiating a drilling operation to extend a length of the wellbore using the downhole tool and at least one of:

a drive system operably coupled to the drill string and adapted to rotate the drill string and thus a drill bit of the downhole tool; or one or more motors of the downhole tool through which the drilling mud is adapted to be circulated to rotate the drill bit;

wherein the one or more operating parameters that are maintained at the substantially constant magnitude during the time window comprise at least one of:

a speed of at least one of the one or more mud pumps;

a flow rate at which the drilling mud is pumped between the surface location and the downhole tool by the one or more mud pumps;

a pressure at which the drilling mud is pumped by the one or more mud pumps;

a rate at which at least one of the one or more mud pumps is ramped up;

a speed at which the drive system rotates the drill string; or a rate at which the drive system is ramped up.

5. A system, comprising:

a downhole tool connected to a drill string and positioned within a wellbore;

one or more mud pumps adapted to ramp up toward a full-operational pumping pressure to circulate a drilling mud via the drill string between a surface location and the downhole tool; and a control system adapted to cause a flow of the drilling mud between the surface location and the downhole tool to stabilize after the one or more mud pumps ramp up toward the full-operational pumping pressure but prior to the one or more mud pumps reaching the full-operational pumping pressure;

wherein the downhole tool is adapted to transmit data via mud-pulse telemetry to the surface location after the flow of the drilling mud between the surface location and the downhole tool is stabilized and while the stabilized flow of the drilling mud is maintained by the control system;

wherein the one or more mud pumps are further adapted to continue to ramp up to the full-operational pumping pressure after the downhole tool transmits the data via the mud-pulse telemetry to the surface location;

wherein the downhole tool includes one or more sensors adapted to detect an operation of the one or more mud pumps, the downhole tool being adapted to wait a predetermined delay time after the operation of the one or more mud pumps is detected by the one or more sensors to transmit the data to the surface location via the mud-pulse telemetry; and wherein, to cause the flow of the drilling mud between the surface location and the downhole tool to stabilize after the one or more mud pumps ramp up toward the full-operational pumping pressure but prior to the one or more mud pumps reaching the full-operational pumping pressure, the control system is adapted to:

create a time window encompassing an expiration of the predetermined delay time; and maintain one or more operating parameters at a substantially constant magnitude during the time window.

6. The system of claim 5, wherein the one or more operating parameters that are maintained at the substantially constant magnitude during the time window comprise at least one of:

a speed of at least one of the one or more mud pumps;

a flow rate at which the drilling mud is pumped between the surface location and the downhole tool by the one or more mud pumps;

a pressure at which the drilling mud is pumped by the one or more mud pumps; or a rate at which at least one of the one or more mud pumps is ramped up.

7. The system of claim 5, further comprising a drawworks operably coupled to the drill string, wherein the one or more operating parameters that are maintained at the substantially constant magnitude during the time window comprise at least one of:

a speed of at least one of the one or more mud pumps;

a flow rate at which the drilling mud is pumped between the surface location and the downhole tool by the one or more mud pumps;

a pressure at which the drilling mud is pumped by the one or more mud pumps;

a rate at which at least one of the one or more mud pumps is ramped up; or a speed at which the drawworks feeds the drill string into the wellbore.

8. The system of claim 5, further comprising at least one of:

a drive system operably coupled to the drill string and adapted to rotate the drill string and thus a drill bit of the downhole tool; or one or more motors of the downhole tool through which the drilling mud is adapted to be circulated to rotate the drill bit;

wherein the one or more operating parameters that are maintained at the substantially constant magnitude during the time window comprise at least one of:

a speed of at least one of the one or more mud pumps;

a flow rate at which the drilling mud is pumped between the surface location and the downhole tool by the one or more mud pumps;

a pressure at which the drilling mud is pumped by the one or more mud pumps;

a rate at which at least one of the one or more mud pumps is ramped up;

a speed at which the drive system rotates the drill string; or a rate at which the drive system is ramped up.

9. A method, comprising:

transmitting, using a downhole tool, data from a wellbore to a surface location via mud-pulse telemetry upon expiration of a predetermined time delay stored by the downhole tool;

pumping, using a mud pump, drilling mud via a drill string between the surface location and the downhole tool; and controlling, using a control system, the mud pump to stabilize a flow of the drilling mud during a time window stored by the control system;

wherein the time window stored by the control system encompasses the expiration of the predetermined time delay so that the downhole tool transmits the data to the surface location during the stabilized flow of the drilling mud;

wherein, before said transmitting, using the downhole tool, the data from the wellbore to the surface location via the mud-pulse telemetry upon the expiration of the predetermined time delay, the method further comprises:

detecting, using one or more sensors of the downhole tool, an operation of the mud pump; and beginning the predetermined time delay after said detecting the operation of the mud pump;

wherein, before said controlling, using the control system, the mud pump to stabilize the flow of the drilling mud during the time window, the method further comprises:

beginning the time window after a period of time has passed from when the operation of the mud pump starts; and wherein the method further comprises synchronizing the downhole tool and the control system so that: the mud pump stabilizes the flow of the drilling mud in the drill string during the time window, and the predetermined time delay stored by the downhole tool expires during the time window.

10. The method of claim 9, wherein the one or more sensors comprise: a pressure sensor; a flow sensor; a shock/vibration sensor; or a torque sensor.

11. A system, comprising:

a downhole tool storing a predetermined time delay and being adapted to transmit data from a wellbore to a surface location via mud-pulse telemetry upon expiration of the predetermined time delay;

a mud pump adapted to circulate a drilling mud via a drill string between the surface location and the downhole tool; and a control system storing a time window that encompasses the expiration of the predetermined time delay, the control system being adapted to control the mud pump to stabilize a flow of the drilling mud during the time window so that the downhole tool transmits the data to the surface location during the stabilized flow of the drilling mud;

wherein the downhole tool is configured to begin the predetermined time delay when the downhole tool detects an operation of the mud pump;

wherein the control system is configured to begin the time window after a period of time has passed from when the operation of the mud pump starts; and wherein the downhole tool and the control system are synchronized so that: the mud pump stabilizes the flow of the drilling mud in the drill string during the time window, and the predetermined time delay stored by the downhole tool expires during the time window.

12. The system of claim 11, wherein the downhole tool includes one or more sensors configured to detect the operation of the mud pump, the one or more sensors including at least one of: a pressure sensor; a flow sensor; a shock/vibration sensor; or a torque sensor.

* * * * *